US007096524B1

(12) United States Patent
Cazzini et al.

(10) Patent No.: US 7,096,524 B1
(45) Date of Patent: Aug. 29, 2006

(54) COVER WITH INTEGRATED PATIENT TRANSFER DEVICE

(75) Inventors: Karl Cazzini, Orchard Park, NY (US); Roland E. Flick, Elma, NY (US); Ronald S. Snyder, Orchard Park, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 0 days.

(21) Appl. No.: 11/244,477

(22) Filed: Oct. 6, 2005

(51) Int. Cl.
*A61G 7/14* (2006.01)
*A47G 9/04* (2006.01)

(52) U.S. Cl. ..... 5/81.1 HS; 5/81.1 R; 5/486; 5/496; 5/500; 5/502; 5/926

(58) Field of Classification Search ..... 5/81.1 HS, 5/81.1 R, 486, 496, 497–502, 925, 926, 413 R
See application file for complete search history.

(56) References Cited

U.S. PATENT DOCUMENTS 3,761,973 A * 10/1973 Leventhal ..... 5/484
3,769,642 A * 11/1973 Warman ..... 5/81.1 T
4,069,526 A * 1/1978 Deikel ..... 5/486
4,513,461 A * 4/1985 Tardivel ..... 5/413 R
4,802,251 A * 2/1989 O'Dell ..... 5/502
5,023,969 A * 6/1991 Nattrass ..... 5/486
5,343,578 A * 9/1994 Kettenhofen ..... 5/413 R
5,706,532 A * 1/1998 Kettenhofen ..... 5/413 R
6,467,106 B1 * 10/2002 Heimbrock ..... 5/81.1 C
6,701,544 B1 * 3/2004 Heimbrock ..... 5/81.1 R
6,820,292 B1 * 11/2004 Heimbrock ..... 5/81.1 R
7,032,261 B1 * 4/2006 Heimbrock ..... 5/81.1 HS
7,047,580 B1 * 5/2006 Finn ..... 5/502
2003/0070226 A1 * 4/2003 Heimbrock ..... 5/81.1 R
2005/0102749 A1 * 5/2005 Heimbrock ..... 5/81.1 HS

* cited by examiner

*Primary Examiner*—Robert G. Santos
(74) *Attorney, Agent, or Firm*—Roach Brown McCarthy & Gruber, P.C.; Kevin D. McCarthy

(57) ABSTRACT

The present invention is directed to a patient transfer system. The patient transfer system is positioned on a support area of a first underlying surface's top surface. The support area (a) receives a patient and (b) is defined by a head end, a foot end, a first side and a second side. The patient transfer system has a base sheet, a transfer sheet a support sheet, a first attachment mechanism, and a second attachment mechanism. The base sheet covers the support area and has (a) a pivot line positioned near or at the first side and (b) a transition line positioned near or at the second side. The transfer sheet has (a) a proximal end that connects to the base sheet at pivot line and (b) a distal end that extends to the transition line. The support sheet has (a) a proximal end that connects to the transfer sheet above the transition line and (b) a distal end that extends at least to the pivot line. The first attachment mechanism connects the support sheet's distal end to the base sheet or the transfer sheet's proximal end. The second attachment mechanism connects the transport sheet's distal end to the base sheet.

20 Claims, 4 Drawing Sheets

COVER WITH INTEGRATED PATIENT TRANSFER DEVICE

FIELD OF THE INVENTION

The present invention is directed to a patient transfer device that assists individuals transfer a patient from one underlying surface to another underlying surface. For example and not to be limited to such, the patient is transferred from (a) a bed to a gurney, (b) a gurney to a bed, (c) a gurney to a surgical table, (d) a surgical table to a gurney, and/or (d) equivalents thereof.

BACKGROUND OF THE INVENTION

The most prevalently produced transfer device at the current time is a mattress having an array of laterally extending chambers arranged in a generally rectangular pattern in the center of the mattress, with a continuous, rectangular outer chamber extending around the periphery of the mattress. Several embodiments of this type are shown in U.S. Pat. No. 5,561,873.

In many cases, a patient transfer mattress includes a plurality of inflatable mattress segments. Each mattress segment includes a plurality of small holes in a bottom sheet to create a cushion of escaping air beneath the mattress segment that facilitates sliding movement of the mattress segment along an underlying surface. Each mattress segment also includes at least one pulling member. The pulling member allows a person to easily grab the mattress to pull it from a first underlying surface to a second underlying surface. An example of the pulling member is a pair of handles affixed to the mattress.

Although these mattresses can be cleaned and disinfected after use with various germicidal cleaning solutions, it is preferable to keep the mattress surfaces protected from contact with infectious or contaminating body fluids. This has been accomplished in prior art air mattresses by providing a sanitary sheet, essentially identical to the top sheet of the mattress, which is folded and inserted in a pouch at the foot end of the mattress. This sheet, referred to as a "sani-liner", is intended to be removed from the pouch and laid over the top sheet of the deflated mattress before the patient is placed upon the mattress. When the mattress is then inflated, the sani-liner sheet protects the top surface of the mattress from potentially infectious material. The sani-liner can later be cleaned and disinfected, folded and returned to the pouch.

The present invention solves these problems of having bulky patient-transfer mattresses and additional sani-liners.

SUMMARY OF THE INVENTION

The present invention is directed to a patient transfer system. The patient transfer system is positioned on a support area of a first underlying surface's top surface. The support area (a) receives a patient and (b) is defined by a head end, a foot end, a first side and a second side. The patient transfer system has a base sheet, a transfer sheet a support sheet, a first attachment mechanism, and a second attachment mechanism. The base sheet covers the support area and has (a) a pivot line positioned near or at the first side and (b) a transition line positioned near or at the second side. The transfer sheet has (a) a proximal end that connects to the base sheet at pivot line and (b) a distal end that extends to the transition line. The support sheet has (a) a proximal end that connects to the transfer sheet above the transition line and (b) a distal end that extends at least to the pivot line. The first attachment mechanism connects the support sheet's distal end to the base sheet or the transfer sheet's proximal end. The second attachment mechanism connects the transport sheet's distal end to the base sheet.

DETAILED DESCRIPTION OF THE INVENTION

Figure 1:
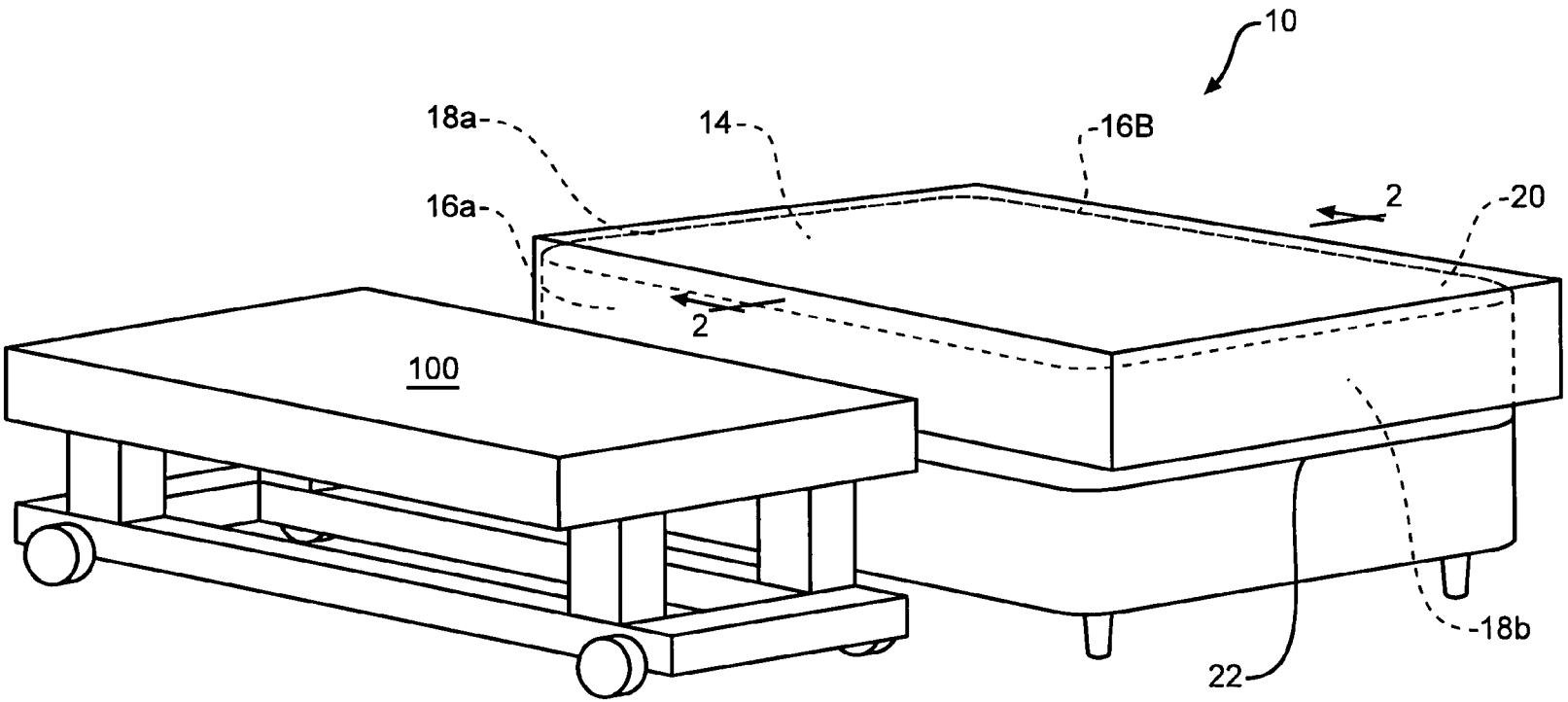
FIG. 1 illustrates a top view of the present invention.

A patient transfer device 10 is illustrated in FIG. 1. The patient transfer device 10 has a base sheet 12. The base sheet 12 can be made of any material that is commonly used as a bed sheet. The material can be a fabric like cotton, silk or a polymer. The base sheet 12 is designed like any conventional bed sheet, preferably a fitted sheet, to fit over the entire and/or a predetermined portion of a mattress 14. For this application the term mattress 14 is not limited to a cushion that is placed over a support structure that allows a person to sit, lie or even have children jump thereon. Instead, the term mattress refers to any (a) support structure like a gurney, a surgical table, a hospital bed, a conventional bed that does not have a pad, a cushion, a conventional mattress and/or a hospital mattress thereon; and (b) a pad, a cushion, a conventional mattress, a hospital mattress and/or a mattress system that lies on such support structures.

Figure 2:
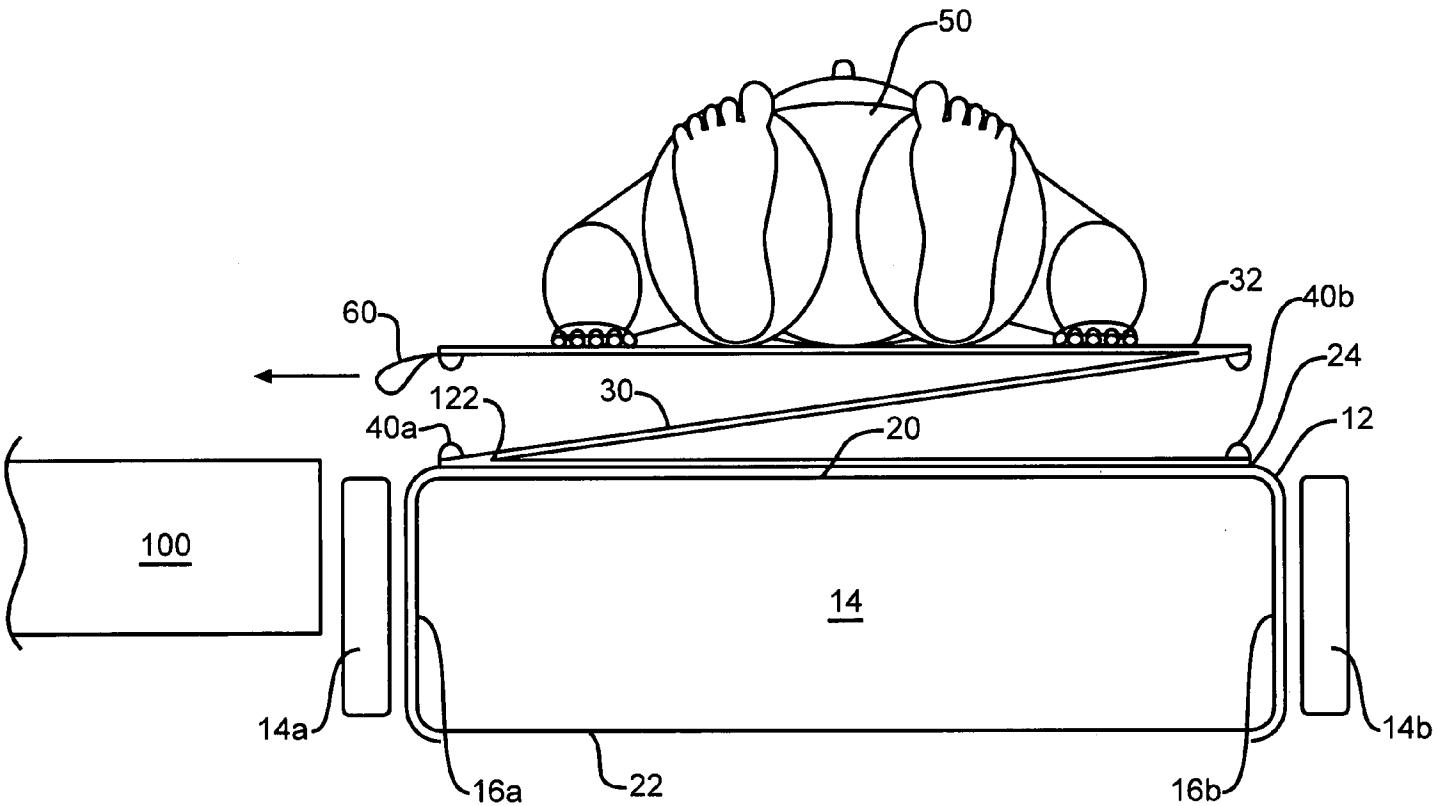
FIG. 2 illustrates a cross-sectional view of FIG. 1 taken along the lines 2—2 with a patient thereon and in the process of transferring a patient from a first underlying surface to a second underlying surface.

If the mattress 14 is a pad, a cushion, a conventional mattress, a hospital mattress and/or a mattress system, the mattress 14 can be any type of a case filled with resilient or quasi-resilient material. The materials can be cotton; gels; gelastic materials; fluid(s) like water, aqueous solution, and/or air; hair; feathers; foam rubber; coiled springs; or any combination thereof. Depending on the type of material used in the case, the case can be primarily made from a fabric material, a polymeric material, or combinations thereof. Examples of such mattresses include and are not limited to a Sealy™ mattress, and Gaymar's Clini-Dyne® Lateral Rotation with Low-air-loss Pressure Relief; duo•gard® Static Air Overlay; G.A.P.™ Overlay; ISOFLEX®: Clinical, Cost Effective Pressure and Shear Management; Jairy Chair Pad™; Paradise® Pumps & Pad Alternating Pressure Overlay System; Pillo-Pump & Airflo Pump Alternating Pressure System; Sof•Care® Chair Cushion; Sof•Care® Pressure Relieving Air System; Sof•Matt® ASM Alternating Pressure Mattress Replacement; Sof•Matt® RSM Low-Air-Loss Mattress Replacement; SPR•Plus® III Low-Air-Loss Overlay System; Symmetric•Aire™ Non-Powered Support Surface System; Symmetric•Aire™ Plus Convertible Support Surface System; top•gard® Foam Mattress Replacements; XPRT Pulmonary Mattress; or combinations and equivalents thereof. In some embodiments, the mattress 14 can have side bolsters 14*a*, 14*b* positioned on its sides as illustrated in FIG. 1. The side bolsters 14*a*, 14*b* can be a part of the mattress 14 that is covered by the base sheet (as illustrated in FIG. 1, the bolsters are not explicitly shown) or not (as illustrated in FIG. 2).

Most mattresses 14 are essentially rectangular in shape. A rectangular mattress 14 has two long lengths 16*a,b*, two short widths 18 *a,b*, a top surface 20 and a bottom surface 22. For this application, we will assume the mattress 14 is rectangular with the understanding that the mattress 14 and the corresponding base sheet 12 can be any shape that are used and fit together.

When a patient 50 is transferred from the top surface 20 of the mattress 14 (a.k.a., first underlying surface) to a second underlying surface 100 (it can be another mattress 14), the patient 50 is normally transferred from the top surface 20 in the direction toward, normally, one of the lengths 16*a,b* and/or widths 18*a,b*. For this application, we will assume the patient 50 is transferred in the direction of length 16*a* as illustrated in FIG. 2. On the base sheet 12 at or near the perimeter of the top surface 20 and along or near the length 16*a* is a pivot line 122. On the opposite side of the base sheet 12 at or near the perimeter of the top surface 20 and along or near the length 16*b* is a transitional line 24.

The pivot line 122 and the transitional line 24 can be positioned on opposite sides of the mattress 14; at or near the widths 18 *a,b* and/or any other area that assists in the transfer of a patient from a first underlying surface to a second underlying surface. We have identified only one set of preferred locations of these lines and by no means is this preferred embodiment to limit the scope and/or breadth of this application.

At the pivot line 122, a transport sheet 30 attaches to and extends from the base sheet 12. The transport sheet 30 extends from the pivot line 122 (the proximal end 31) to the transitional line 24 (distal end 37) when patient is not being or been recently moved.

At the transitional line 24, a support sheet 32 attaches to the transport sheet 30's distal end 37. The support sheet 32 extends from the distal end 37 toward the pivot line 122 and may extend beyond the line 122 when patient is not being or been recently moved. At least one handle and/or gripping device 60 is attached to the support sheet's distal end 78 and the device 60 extends beyond the pivot line 122. The handle device 60 allows a person who is transferring the patient 50 to have an opportunity to properly grasp the transfer device 10.

When the patient transfer device 10 is not transferring a patient 50 from the mattress 14 to a second underlying surface 100, (1) the support sheet's 32 distal end 78 interconnects 40*a* to (a) the transport sheet 30 at or near the proximal end 31 and/or (b) the base sheet 12 at and/or near the pivot line 122 and (2) the transport sheet's 30 distal end 37 (at and/or near the transitional line 24) interconnects 40*b* to the base sheet 12 at and/or near the transitional line 24.

The interconnection 40*a,b* occurs through various and possibly different devices when the patient 50 is not being or been recently moved. The various and possibly different attachment devices 40*a,b* include and are not limited to a zipper, a tongue and groove system (like a zip-lock unit), a hook and loop system, snap systems, button and button hole systems, and any other conventional attachment system and/or combinations thereof. Preferably the interconnection system 40*a,b* should not increase the discomfort to the patient 50.

When the patient is being or been recently moved, as illustrated in FIG. 2, the interconnections 40*a,b* are disconnected. Once the interconnection device 40*a,b* is disconnected, the person moving the patient 50 can properly grab the handle device 60 for easier transfer of the patient to the desired second undersurface 100. Presumably, that person will pull the support sheet 32 toward the second underlying surface 100. The support sheet 32 will slide against the transport sheet 30 and possibly other portions of the base sheet 12, the mattress 14, and the second underlying surface 100. It is possible the transport sheet 30 could extend so it is in the same plane as the support sheet 32 and a tangential line from the base sheet's (12) top surface.

To decrease the friction between the various sheets, 12, 30, and 32, and the sheets in relation to the underlying surfaces 14 and 100; the device 10 could have a lubricant positioned between sheets 30 and 32 and possibly sheets 30 and 12. The lubricant should be non-toxic and not deleterious to the patient, patient transfer system 10 and mattress 14.

Figure 3:
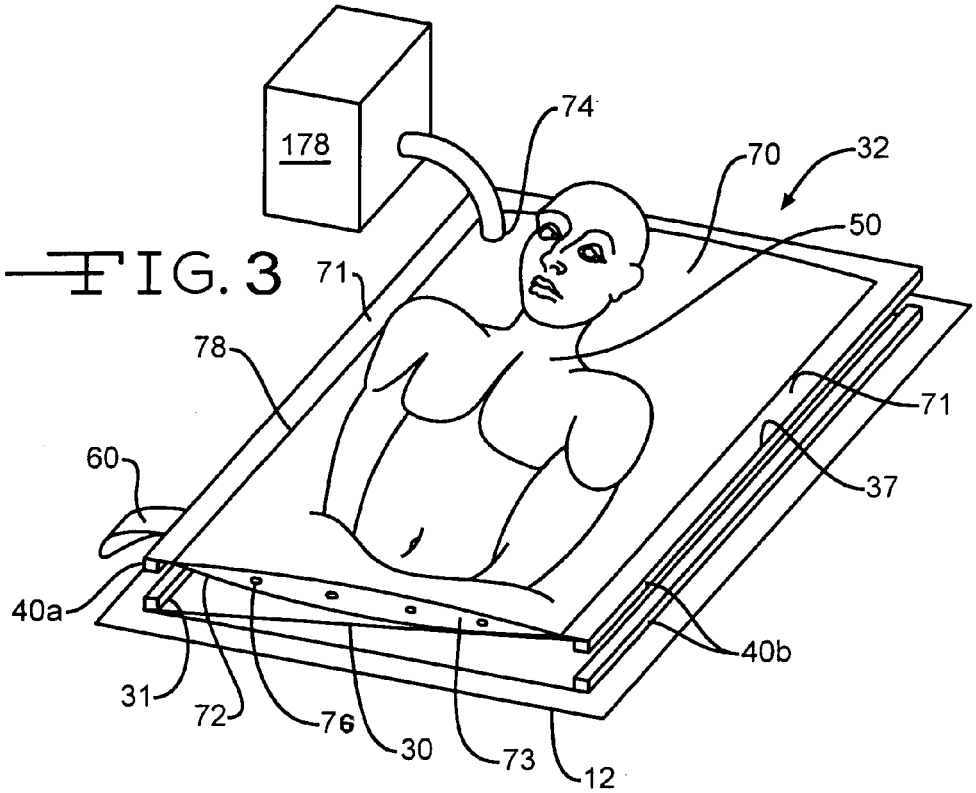
FIG. 3 illustrates an alternative embodiment of FIG. 2 from an angled top view.

Alternatively, the support sheet 32 could have a patient layer 70, a bottom layer 72, a cavity 73 formed by joining 71 the patient layer 70 and the bottom layer 72 together at least at the periphery and possibly in the interior of the cavity 73, an air aperture 74 that allows air to be delivered into the cavity 73, and a plurality of escape apertures 76 on the bottom layer 72 as illustrated in FIG. 3. The air aperture 74 receives air from a pressurized air source 178. The air circulates in the cavity and escapes through the escape apertures 76. The escaped air provides an air space between the support sheet 32 and at least the transport sheet 30 to decrease the friction between the support sheet 32 and the other layers when the patient is being moved.

Figure 4:
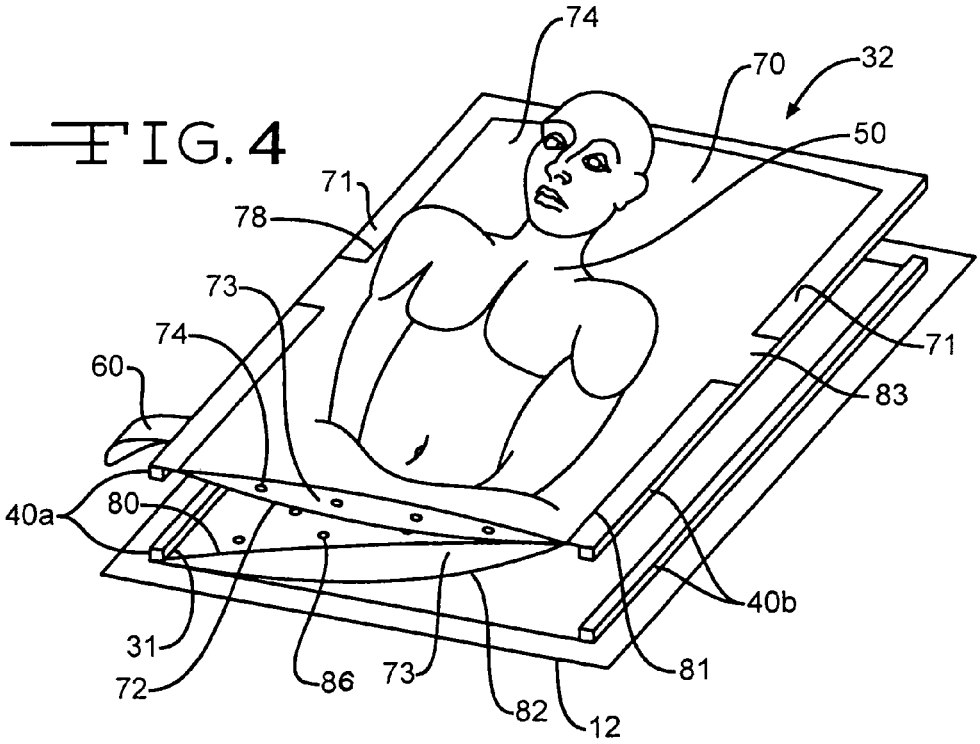
FIG. 4 illustrates an alternative embodiment of FIG. 3.

In addition to the air cavity alternative embodiment, the transport sheet 30 can also have a top layer 80, a bottom layer 82, the cavity 73 being extended when the top layer 80 and the bottom layer 82 are joined together at least at the periphery 81 and possibly in the interior of the cavity 73 with at least one air opening 83 between the support sheet 32 cavity to the transport sheet 30 cavity, and a plurality of escape apertures 86 on the top layer 80 as illustrated in FIG. 4. The air aperture 74 receives air from a pressurized air source 178. The air circulates in the cavity and escapes through the escape apertures 76, 86. The escaped air provides an air space between the support sheet 32 and transport sheet 30 to decrease the friction between the sheets when the patient is being moved.

The air opening 83 can be a flexible conduit, like a tube, within or exterior to the layers 70, 72, 80, 82; a gap in the joining of the peripheries of layers 70, 72, 80, 82; or combinations of both embodiments. The flexible tube inhibits the kinking of the air passage 83.

Figure 5:
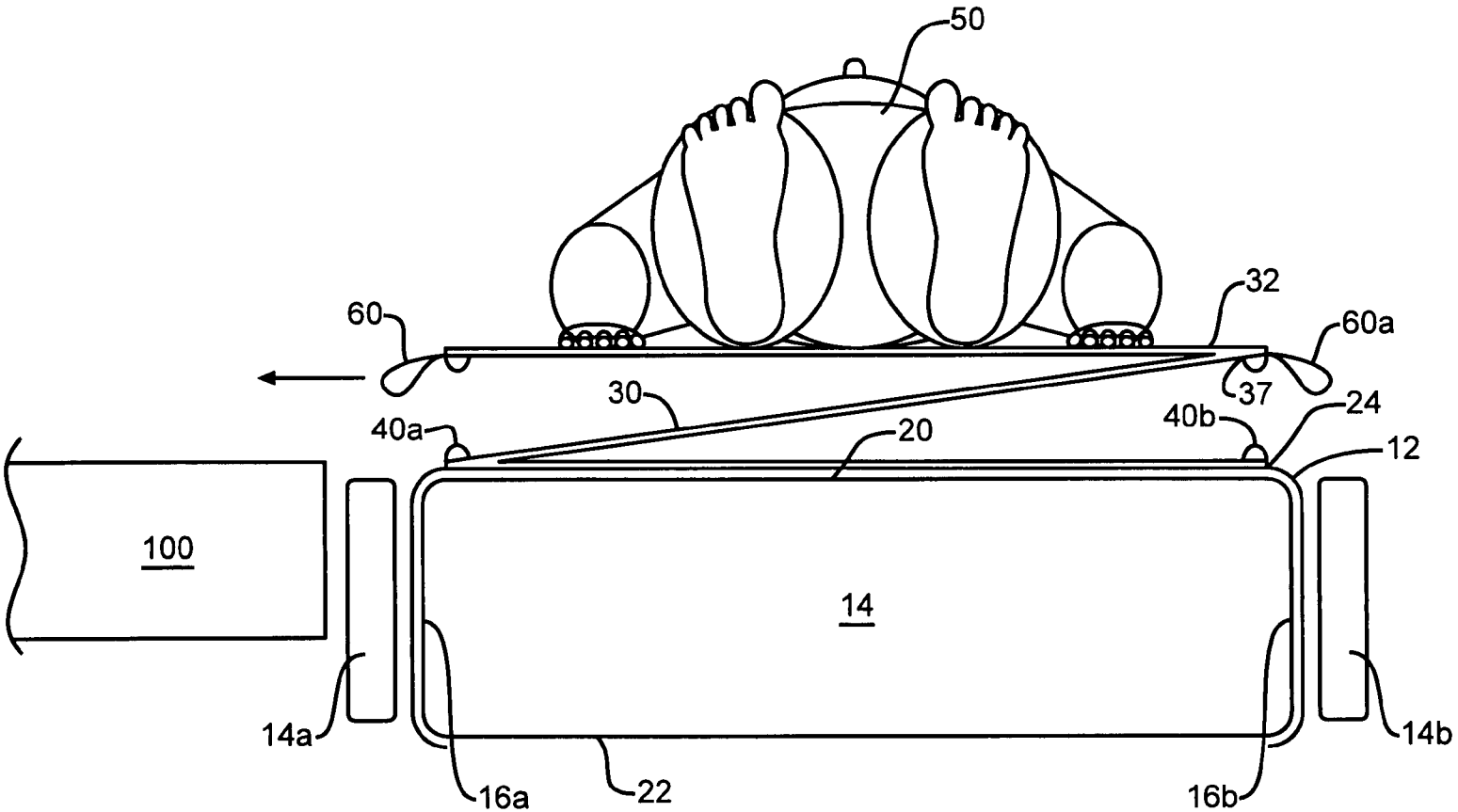
FIG. 5 illustrates an alternative embodiment of FIG. 2.

Another alternative embodiment is illustrated in FIG. 5 which is an alternative embodiment of FIG. 2. This alternative embodiment has a third attachment device 40*c* that is positioned at or near the support sheet's 32 proximal end 39 and/or the transport sheet's 30 distal end 37. The attachment device 40*c* allows the person(s) who are transferring the patient 50 to disconnect the support sheet 32 from the remainder of the sheets 12, 30. That disconnect allows a second support sheet 32 (not shown) to be attached to the sheets 12, 30, and/or allows the original support sheet 32 to be re-attached after the patient returns to the mattress 14.

In addition, a second set of handles 60*a* can be positioned at or near the support sheet's 32 proximal end and on the condition that the handles 60*a* remain on the support sheet 32 after the support sheet 32 is detached from the transport sheet through the third attachment device 40*c*. The second set of handles 60*a* allow the transferee to obtain a desired grip and/or handle on the support sheet 32 for an easier transfer of the patient 50.

Although a particular preferred embodiment of the invention has been illustrated and described in detail for illustrative purposes, it will be recognized that variations or modifications of the disclosed apparatus, including the rearrangement of parts, lie within the scope of the invention defined by the claims.

We claim:

1. A patient transfer system positioned on a support area of a mattress' top surface wherein the support area receives a patient and is defined by at least a first side and a second side that is opposite the first side, the patient transfer system comprising a base sheet covers the support area and having (a) a pivot line positioned near or at the first side and (b) a transition line positioned near or at the second side;

a transfer sheet having (a) a proximal end that connects to the base sheet at the pivot line and (b) a distal end that extends to the transition line;

a support sheet having (a) a proximal end that connects to the transfer sheet above the transition line and (b) a distal end that extends at least to the pivot line;

a first attachment mechanism connects the support sheet's distal end (a) to the base sheet or (b) the transfer sheet's proximal end;

a second attachment mechanism connects the transport sheet's distal end to the base sheet.

2. The patient transfer system of claim 1 wherein a handle/grip device is attached to the support sheet's distal end.

3. The patient transfer system of claim 1 wherein a lubricant is applied between the support sheet and the transfer sheet.

4. The patient transfer system of claim 3 wherein the lubricant is applied between the transfer sheet and the base sheet.

5. The patient transfer system of claim 1 wherein a lubricant is applied between the transfer sheet and the base sheet.

6. The patient transfer system of claim 1 wherein the support sheet has a first top layer and a first bottom layer that are joined together to form a cavity, the cavity receives air from an air source through an air aperture, and the air circulates in the cavity and is released from the cavity through a first plurality of escape apertures positioned on the first bottom layer to create an air space.

7. The patient transfer system of claim 6 wherein the transfer sheet has a second top layer and a second bottom layer that are joined together to form an extension of the cavity, and the air circulates in the extension of the cavity and is released from the extension of the cavity through a second plurality of escape apertures positioned on the second top layer to create an air space.

8. The patient transfer mattress of claim 1 wherein the support area includes a side bolster.

9. The patient transfer mattress of claim 1 further comprising a third attachment device positioned at and/or near the connection between the support sheet's proximal end and the transport sheet's distal end.

10. The patient transfer mattress of claim 2 further comprising a second handle/grip device attached to the support sheet's proximal end.

11. A method to transfer a patient from a first underlying surface to a second underlying surface, comprising:

positioning a patient transfer apparatus on a support area of a mattress having a top surface wherein the support area is on the top surface, receives a patient and is defined by at least a first side and a second side that is opposite the first side; the patient transfer apparatus comprises (A) a base sheet covers the support area and has (a) a pivot line positioned near or at the first side and (b) a transition line positioned near or at the second side;

(B) a transfer sheet having (a) a proximal end that connects to the base sheet at the pivot line and (b) a distal end that extends to the transition line;

(C) a support sheet having (a) a proximal end that connects to the transfer sheet above the transition line and (b) a distal end that extends at least to the pivot line;

(D) a first attachment mechanism that connects the support sheet's distal end (a) to the base sheet or (b) the transfer sheet's proximal end;

(E) a second attachment mechanism that connects the transport sheet's distal end to the base sheet;

unattaching (a) the support sheet's distal end from the base sheet or the transfer sheet's proximal end and (b) the transport sheet's distal end from the base sheet;

pulling the support sheet onto the second underlying surface that is positioned near the support area's first side.

12. The method of claim 11 wherein a handle/grip device is attached to the support sheet's distal end.

13. The method of claim 11 wherein a lubricant is applied between the support sheet and the transfer sheet.

14. The method of claim 13 wherein the lubricant is applied between the transfer sheet and the base sheet.

15. The method of claim 11 wherein a lubricant is applied between the transfer sheet and the base sheet.

16. The method of claim 11 wherein the support sheet has a first top layer and a first bottom layer that are joined together to form a cavity, the cavity receives air from an air source through an air aperture, and the air circulates in the cavity and is released from the cavity through a first plurality of escape apertures positioned on the first bottom layer to create an air space.

17. The method of claim 16 wherein the transfer sheet has a second top layer and a second bottom layer that are joined together to form an extension of the cavity, and the air circulates in the extension of the cavity and is released from the extension of the cavity through a second plurality of escape apertures positioned on the second top layer to create an air space.

18. The method of claim 11 wherein the support area includes a side bolster.

19. The method of claim 11 further comprising a third attachment device positioned at and/or near the connection between the support sheet's proximal end and the transport sheet's distal end.

20. The method of claim 12 further comprising a second handle/grip device attached to the support sheet's proximal end.

* * * * *